United States Patent [19]

Orenstein

[11] Patent Number: 4,916,362

[45] Date of Patent: Apr. 10, 1990

[54] EXCITATION SUPPLY FOR GAS DISCHARGE TUBES

[75] Inventor: Edward D. Orenstein, Edina, Minn.

[73] Assignee: Neon Dynamics Corporation, Minnetonka, Minn.

[21] Appl. No.: 177,694

[22] Filed: Apr. 5, 1988

[51] Int. Cl.[4] ..... H05B 41/36

[52] U.S. Cl. ..... 315/219; 315/223; 315/225; 315/226; 315/291

[58] Field of Search ..... 315/209 R, 219, 223, 315/226, 247, 291, 307, 225

[56] References Cited

U.S. PATENT DOCUMENTS

| | | | |
|---|---|---|---|
| 2,355,477 | 8/1944 | Stahl | 242/118.7 |
| 3,703,677 | 11/1972 | Farrow | 363/133 |
| 4,187,450 | 2/1980 | Chen | 315/278 |
| 4,274,136 | 6/1981 | Onodera et al. | 363/68 |
| 4,373,146 | 2/1983 | Bonazoli et al. | 315/209 R |
| 4,414,491 | 11/1983 | Elliott | 315/282 |
| 4,523,131 | 6/1985 | Zansky | 315/225 X |
| 4,547,705 | 10/1985 | Hirayama et al. | 315/219 |
| 4,667,132 | 5/1987 | Leale | 315/282 |
| 4,719,390 | 1/1988 | Sairanen | 315/247 X |
| 4,754,199 | 6/1988 | Parker | 315/256 X |

FOREIGN PATENT DOCUMENTS

| | | |
|---|---|---|
| 066927 | 12/1982 | European Pat. Off. . |
| 68014 | 10/1973 | Luxembourg . |
| 86/06572 | 11/1986 | PCT Int'l Appl. . |

OTHER PUBLICATIONS

Letter from Advanced Neon Systems, (undated); "JB Transformer Instructions".

Data Sheet from National Semiconductor describing LM556 Dual Timer Circuit.

*Primary Examiner*—David Mis

*Attorney, Agent, or Firm*—Merchant, Gould, Smith, Edell, Welter & Schmidt

[57] ABSTRACT

The present invention uses a variable frequency oscillator to drive a primary resonant converter output transformer circuit for exciting gas discharge tubes. The combination of the impedance of the resonant conversion circuit along with the impedance of the driven gas discharge tube taken in combination with the frequency of the variable oscillator will determine the output voltage of the circuit. By varying the frequency of the oscillator, the optimal output voltage and hence the optimal brightness of the gas discharge tube may be selected. At the optimal output voltage, the frequency of the switching supply may create an undesirable or desirable "bubble effect" in the gas discharge tube. An optional secondary frequency may be combined with the frequency of the variable frequency oscillator to create or eliminate the bubble effect according to the esthetic desires of the user.

9 Claims, 2 Drawing Sheets

V1
VOUT
V2
T3
F1
C3 1μf 250V
C4 1μf 250V
Q1 IRF620
Q2 IRF620
D
S
G
A
B
C
T2
R1 22Ω 1/2w
C5 1.0μf 250V
C6 .0056μf
LM556
+17VDC
C1 220μf 200V
C2 40μf 25V
C7 .0056μf
R2A 5K
R2B 5K
R5 8K
R4 8.250K 1/4w 1%
R3 5K
C8 .01μf
SW1
CR1 IN5402
CR2
CR3
CR4
CR5 IN4003
CR6
CR7
CR8
T1
L1
L2
110 VAC

EXCITATION SUPPLY FOR GAS DISCHARGE TUBES

FIELD OF THE INVENTION

This invention applies to the field of excitation of gas discharge tubes and more particularly to switching power supplies used for exciting neon, argon, etc., gas discharge tubes.

BACKGROUND OF THE INVENTION

The most common gas discharge tube in use today is the neon sign. When a current is passed through an inert gas such as neon or argon held in a discharge tube, the gas will glow at a characteristic color, such as red in the case of neon. In order to excite the gas in a discharge tube, a sufficiently high voltage must be maintained between electrodes on either end of the discharge tube to allow current to flow. This calls for a high voltage power supply to drive the tube.

Excitation power supplies, and in particular neon light transformers of the prior art, have been known for many years. The most common neon light transformer is a 60Hz, 120VAC primary with a 60Hz approximately 10KV secondary which is directly connected to the electrodes attached to either end of the neon sign. A transformer of this size tends to weight 10–20 pounds due to the massive core, number of primary and secondary windings, and the potting of the transformer in a tarlike material to prevent arcing. This results in a very large, bulky and unsightly excitation supply.

More recently, light-weight switching power supplies have been used to step up the 60Hz 120VAC voltage to a higher frequency, higher fixed voltage level for exciting discharge tubes. In general, the switching frequency is fixed at the factory and not matched against the load impedance of the gas discharge tube to which it is attached, resulting in a fixed output voltage. This impedance mismatch causes a great loss in efficiency and sometimes an interesting side effect. The length and volume of the discharge tube as well as the gas pressure, temperature and type of gas used in the discharge tube all have an effect on the characteristic impedance of the discharge tube. A fixed frequency, fixed output impedance excitation supply attached to a variety of gas discharge tubes may cause impedance mismatches which could result in the "bubble effect". This effect is caused by standing waves appearing at a high frequency within the discharge tube, resulting in alternate areas of light and dark in the tube. The standing wave may not be exactly matched to the length of the tube, resulting in a scrolling or crawling bubble effect in which the bubbles slowly move toward one end of the tube. This may be an undesirable effect in some neon signs, or may be desired in others. The problem, however, is that with fixed frequency output gas discharge tube excitation supplies, the resulting effect is unpredictable.

The prior art also developed variable frequency switching power supplies for exciting gas discharge tubes to make the foregoing bubble effect more predictable. By attaching an excitation supply to a gas discharge tube and varying the frequency, one could either eliminate or accentuate the bubble effect. This resulted in an acceptable solution to the unpredictability of the bubble effect, but did not solve the impedance mismatch problem or allow a variable output voltage for setting the optimal brightness. In order to get the best transfer flow of power from the excitation supply through the gas discharge tube, the output impedance of the switching supply must be matched to the input impedance seen at the terminals of the discharge tube. The frequency at which this impedance match is most closely satisfied may actually result in a bubble effect when one is not needed, or may not result in a bubble effect when one is desired. In order to satisfy the user with the correct esthetic result the frequency must be varied, which may result in an impedance mismatch. An impedance mismatch results in a less than optimal output voltage from the supply and light output of the discharge tube, a too-intense light output of the discharge tube, no excitation at all, standing waves (either fixed or moving), or any combination of the above. Thus, if a user varies the frequency of a variable frequency excitation supply to obtain the desired esthetic effect of the bubble effect, the resulting unmatched impedance may cause the discharge tube to be too dim or too bright.

Thus there is a need in the prior art for a variable frequency, variable output voltage excitation supply which allows for matching or varying the output impedance of the transformer to most closely match the input impedance of a variety of gas discharge tubes in order to gain the optimal combination of intensity and bubble effect.

SUMMARY OF THE INVENTION

To overcome the shortcomings of the prior art, the present invention varies at least one frequency from a timing means to drive a resonant primary output transformer for exciting gas discharge tubes. A prime frequency is varied to find the correct impedance matching to vary the output voltage and hence the intensity of the discharge tube, and an optional secondary frequency is used to create or eliminate the bubble effect according to the esthetic desires of the user.

BRIEF DESCRIPTION OF THE DRAWINGS

In the drawings, where like numerals describe like components throughout the several views.

DETAILED DESCRIPTION OF THE PREFERRED EMBODIMENT

In the following detailed description of the preferred embodiment, reference is made to the accompanying drawings which form a part hereof, and in which is shown by way of illustration a specific embodiment in which the invention may be practiced. This embodiment is described in sufficient detail to enable those skilled in the art to practice the invention, and it is to be understood that other embodiments may be utilized and that structural changes may be made without departing from the scope of the present invention. The following detailed description is, therefore, not to be taken in a limiting sense, and the scope of the present invention is defined by the appended claims.

Figure 1:
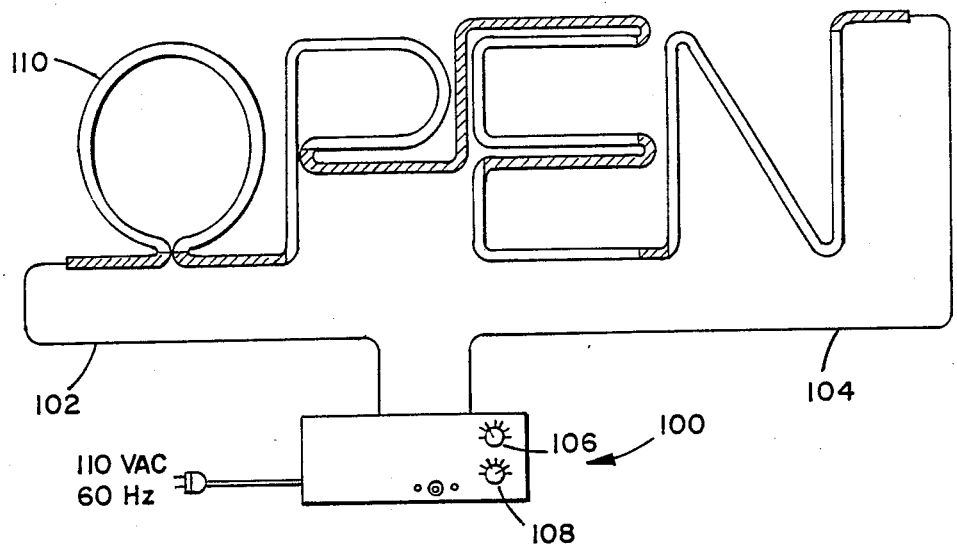
FIG. 1 shows the application of the present invention for driving a neon sign.

FIG. 1 shows the application of the present invention to a gas discharge tube 110 which in this application is a neon sign reading OPEN. The hashed or darkened areas of the discharge tube are those portions of the tube which are covered with black paint or the like such that the individual letters of the word are viewed by the observer. This application of neon discharge tubes bent in the shape of words is well known in the art. The discharge tube excitation power supply 100 is shown attached by electrodes 102 and 104 to opposite ends of the discharge tube 110. The supply receives its operating voltage from the AC mains which in the U.S. is commonly found to be 110VAC at 60Hz.

The excitation supply is shown with two knobs 106 and 108 which are used to vary the primary and secondary frequencies of the supply, as described in more detail below. Knob 106 is used to set the primary operating frequency and output voltage of the supply 100 to obtain the best brightness or output impedance match between the supply 100 and the discharge tube 110. Once the optimal brightness has been obtained, knob 108 can be varied to enhance or remove the bubble effect which may be created in the discharge tube 110. The secondary frequency impedes the bubble effect by distorting the standing wave a sufficient amount to eliminate the dark portions between the light portions in the tube 110 or it ma enhance the effect by generating standing waves at harmonic frequencies of the primary frequency.

Figure 2:
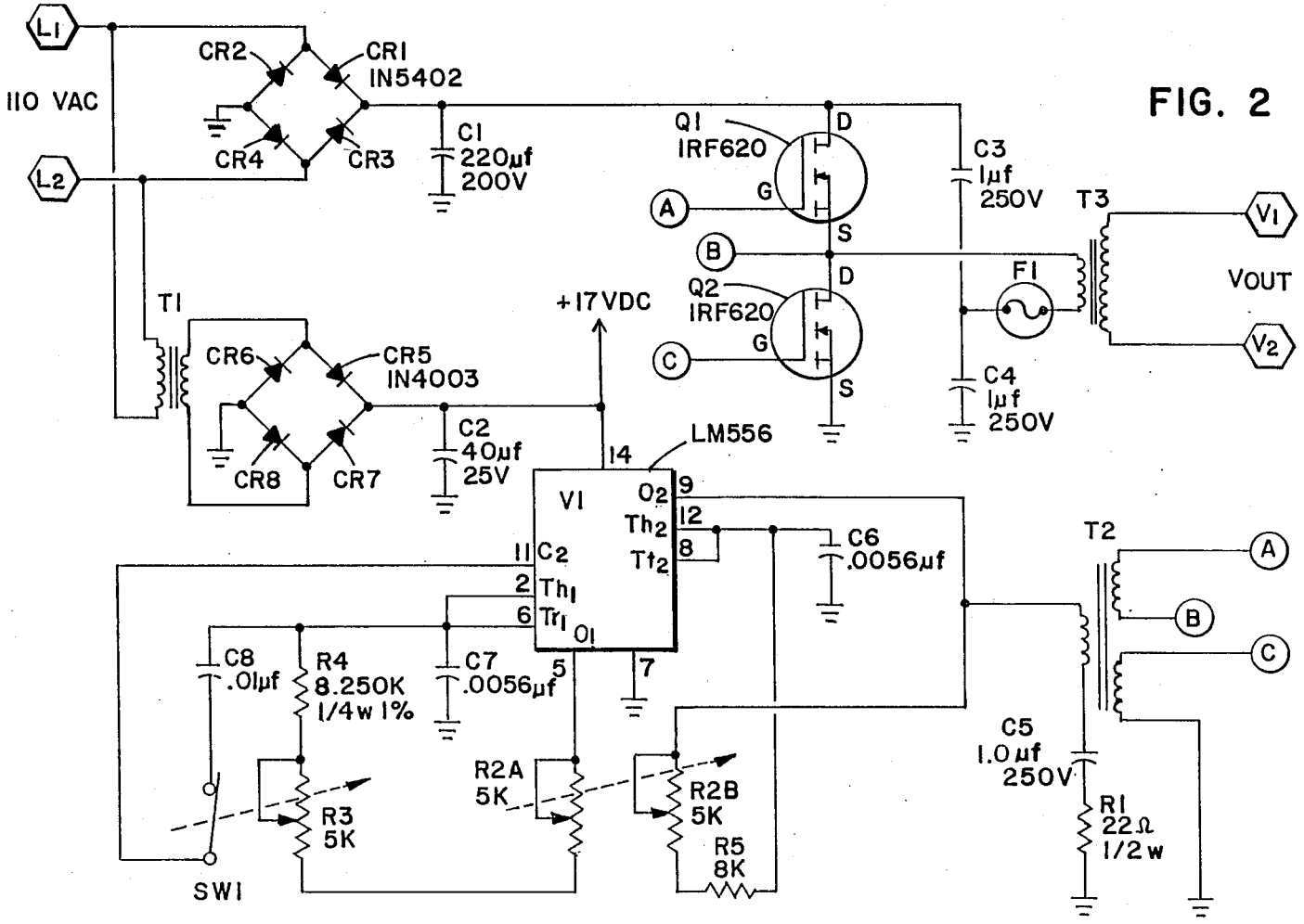
FIG. 2 is a detailed electrical schematic diagram of the present invention.

Referring to FIG. 2, the detailed electrical operation of the preferred embodiment of the present invention will be described. The 110VAC 60Hz mains supply is provided on lines L1 and L2 in the upper left of FIG. 2. The primary operating current is rectified through a bridge rectifier comprised of diodes CR1 through CR4. The resultant direct current is filtered by bulk capacitor C1 which in the preferred embodiment is 220 microfarads. Direct rectified line voltage off AC mains is typically 160VDC peak. The DC voltage stored in capacitor C1 and continuously supplied from the AC mains is applied to the primary of main power transformer T3 through capacitors C3 and C4 and transistors Q1 and Q2. These capacitors along with the input inductance seen by the primary on power transformer T3 form a resonant converter circuit which switches the DC power through to the secondary of stepup power transformer T3. The resultant switched current is applied through the output terminals $V_1$ and $V_2$ to the discharge tube for exciting the gas therein. As is understood by those skilled in the art, the impedance of the discharge tube attached to the terminals $V_1$ and $V_2$ will affect the impedance seen at the primary of transformer T3 and thus will affect the optimal power transfer point based on the switching frequency of the resonant converter. Thus, depending upon the impedance attached to terminals $V_1$ and $V_2$, the optimal switching frequency must be selected to effect the best possible power transfer. By varying the switching frequency, the output voltage Vout may be varied between 4KV–15KV, depending upon the impedance of the discharge tube attached between $V_1$- $V_2$.

The voltage switched through the resonant converter on power transformer T3 is switched through power MOSFETs Q1 and Q2. These transistors in the preferred embodiment are Part No. IRF620 available from International Rectifier and other vendors. The gates of these MOSFETs are controlled such that neither MOSFET is on at the same time. The alternating switching of the gates of transistors Q1 and Q2 vary the direction of the current through the primary of power transformer T3. The alternate switching of transistors Q1 and Q2 cause a resonant current to develop in the primary which is in turn transferred to the secondary and on to the discharge tube 110. Control of the power MOSFETs Q1 and Q2 is effected by the switching control circuit shown in the lower half of FIG. 2.

In the preferred embodiment of the present invention, the main controller for establishing the switching frequencies is by means of a dual timer circuit, Part No. LM556 available from National Semiconductor, Signetics, and a wide variety of other vendors. This LM556 timer circuit contains two individual 555-type timers which form the timing control mechanisms for establishing the switching frequencies.

The supply voltage for driving the 556 timer U1 is by means of a DC supply circuit connected to the AC mains. The control supply transformer T1 is attached across lines L1 and L2 of the AC mains and serves to step down the AC mains voltage to approximately 20VAC which is applied to a full-wave rectifier bridge comprised of diodes CR5 through CR8. The resultant rectified pulsed DC voltage is filtered by capacitor C2 which is in the preferred embodiment a 40-microfarad capacitor. The resultant 17VDC low-voltage supply is applied between pins 14 and 7 of the timer circuit U1.

The dual 556 timing circuits are each operable in oscillator mode in which the frequency and duty cycle are both accurately controlled with external resistors and one capacitor. By applying a trigger signal to the trigger input, the timing cycle is started and an internal flip-flop is set, immunizing the circuit from any further trigger signals. The timing cycle can be interrupted by applying a reset signal to the reset input pin. Those skilled in the art will readily recognize that a wide variety of timing circuits may be substituted for the type described here. For example, monostable multivibrator circuits, RC timing circuits, microcontroller or microprocessor circuits may be substituted therefor without departing from the spirit and scope of the present invention. The use and selection of the 556 timing circuit in the present application is only one of a variety of preferred implementations.

The dual timer circuits of integrated circuit U1 are controlled with the discrete components shown in FIG. 2 following manufacturer's suggestions for the use of the 556. Variable resistors R2A and R2B are ganged together and control the oscillation frequencies of the timers. The frequencies of the timers are fixed and move together as the user changes resistor R2 (corresponding to knob 106 shown on the supply 100 of FIG. 1). Variable resistor R3 is used to control the mixing point of the two frequencies (corresponding to knob 108 on the supply 100 of FIG. 1). The mixing point of the two frequencies results in a pulse modulation effect in the final mixed output frequency.

Timing capacitor C7 is connected to the threshold and trigger inputs to the first timer (pins 2 and 6, respectively) in the LM556 timer chip U1. Also connected to the threshold and trigger inputs is the series resistance comprised of variable resistor R2A, variable resistor R3, and fixed resistor R4. This R-C combination determines the frequency of operation of the first oscillator.

The output of the first oscillator is fed through capacitor C8 to the control input (pin 11) of the second oscillator circuit. The trigger and threshold inputs (pins 8 and 12 respectively) of the second oscillator circuit are connected to timing capacitor C6. The series resistance comprised of variable resistor R2B and fixed resistor R5 provide the discharge path for capacitor C6. Together, this R-C combination determines the timing frequency of the second oscillator. The frequency of oscillation of the second oscillator is interrupted by the frequency of oscillation of the first oscillator circuit through the control input (pin 11) for the second oscillator.

The resulting output frequency on output pin 9 is a pulse modulation mixed frequency used to drive the primary of control transformer T2. The output pulses on pin 9 of chip U1 are passed to the primary of control transformer T2 and find their path to ground through series capacitor C5 and resistor R1. Thus, whenever the output on pin 9 changes state, a small positive-going or negative-going current spike will appear in the primary of control transformer T2. This control signal on the primary is reflected on the control windings of the secondary which are used to control power MOSFETs Q1 and Q2 which ultimately control the switching of the high voltage DC into the power output transformer T3.

The construction of transformers T1, T2 and T3 shown in FIG. 2 are within the skill of those practicing in the art. Transformers T1 and T2 are commonly available transformers or they may be specially constructed according to the specific application of this device. Control transformer T2 in the preferred embodiment is a 70-turn primary with two 100-turn secondaries, creating a 0.7:1.0 transfer ratio. The primary and secondaries are wound using 36-gauge wire on a common core and bobbin. Power transformer T3 is of a more exacting construction due to the high voltage multiplication on the secondary. The primary is constructed with 75 turns of #20 single insulated stranded wire wound around a high voltage isolation core very similar to those used in the flyback transformers of television sets. The secondary is wound on a high isolation core comprised of 4,000 turns of #34 wire. The secondary is separated into a plurality of segmented windings to reduce the chance of arcing between windings and allows operation at higher frequencies by reducing the capacitance between the windings. For example, the secondary could be segmented into 6–8 separate windings separated by suitable insulation to prevent arcing and potted in commonly available insulating plastic to minimize arcing.

In operation, the power supply of FIG. 2 is attached to the AC mains through lines L1 and L2. A gas discharge tube is attached between the output terminals $V_1$ and $V_2$ of power transformer T3. For initial setup, variable resistor R3 is turned fully counterclockwise and the ganged switch SW1 connected to variable resistor R3 is in the open position. Thus, during initial setup, with switch SW1 open, the operating frequency of the first oscillator cannot affect the control input (pin 11) of the second oscillator circuit. In this fashion, the output voltage controlling the brightness selected by the main operating frequency of the second oscillator can be tuned first by tuning R2 before attempting to eliminate or enhance the bubble effect by tuning R3.

With switch SW1 open and control R3 at the fully counterclockwise position, variable resistor R2 is tuned to create the optimal switching frequency for controlling switching transistors Q1 and Q2 which result in the optimal output voltage or preferred brightness in the discharge tube attached to the secondary of power transformer T3. When the correct voltage or brightness setting is selected, a bubble effect may or may not be seen in the discharge tube. To enhance or reduce the bubble effect, variable resistor R3 is turned clockwise to close switch SW1 and to change the mixing point of the frequencies of oscillators 1 and 2 of timer circuit U1.

Figure 3:
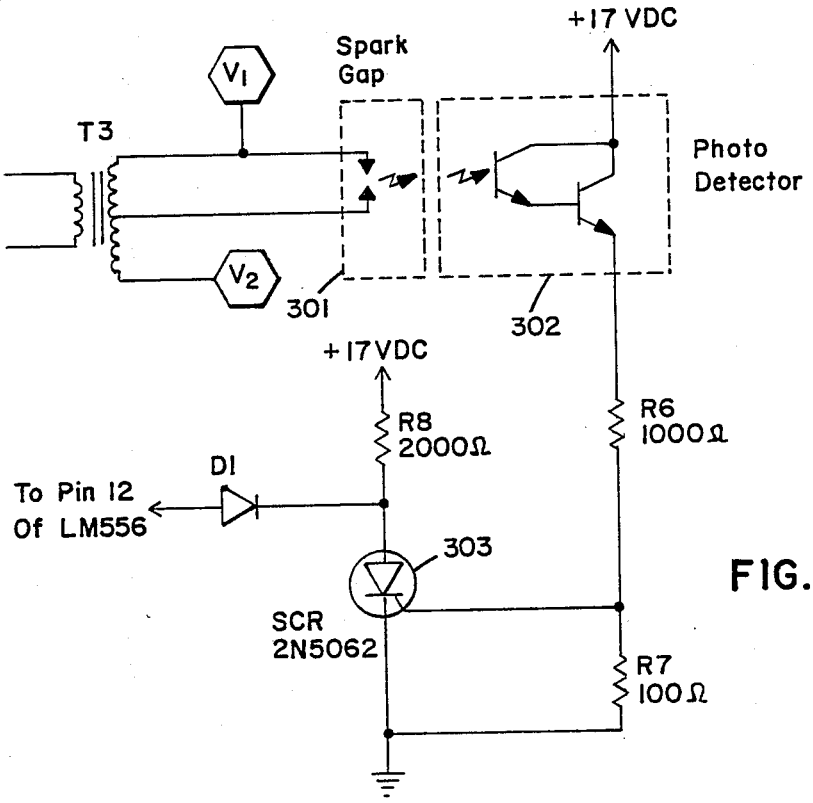
FIG. 3 is a detailed electrical schematic diagram of an overvoltage runaway protection circuit.

The preferred embodiment of the present invention is designed such that a short between the outputs V1 and V2 can be maintained indefinitely without causing damage to the supply. If, however, supply 100 is energized with no load placed between V1–V2, the output voltage will tend to run away due to an infinite impedance on the secondary transformer T3. To prevent overvoltage runaway, the circuit of FIG. 3 is used to shut down the oscillator of the timing circuit LM556 when overvoltage condition is sensed. A commonly available spark gap can be placed between one of the output lines and one of the aforementioned segmented secondary coils, or may be placed between V1 and V2. The spark gap is selected for the upper limit of output voltage allowable at supply 100. When a spark is created on spark gap 301, the light created by the sparking is sensed by photodetector circuit 302. Detector circuit 302 is in the preferred embodiment and photo-Darlington amplifier, part No. L14R1 available from General Electric and other vendors. When activated, photodetector 302 will cause a current to flow from the +17VDC supply through resistors R6 and R7 to ground. Current through resistor R6 will tend to pull the trigger line of SCR 303 high, triggering the SCR. With an active signal on the trigger line for SCR 303, current is allowed to flow from the +17VDC supply through resistor R8 to ground. As is known by those skilled in the art, once an SCR is energized, it tends to remain energized until current through the SCR is removed. Thus, a latching function is created, disabling the supply 100 until it is deenergized to reset SCR 303. When SCR 303 is energized, current is drawn from pin 12 of the LM556 timing circuit through diode D1 onto ground. The grounding of pin 12 effectively shuts down all the timing functions and stops the oscillation through transformer T3.

While the present invention has been described in connection with the preferred embodiment thereof, it will be understood that many modifications will be readily apparent to those of ordinary skill in the art, and this application is intended to cover any adaptations or variations thereof. Therefore, it is manifestly intended that this invention be limited only by the claims and the equivalents thereof.

What is claimed is:

1. An excitation device for use with gas discharge tubes having an impedance, comprising:

oscillator means for producing a first switching signal of a first selectable frequency;

means for producing a second switching signal of a second selectable frequency;

conversion means responsive to said first switching signal and said second switching signal for producing high voltage;

said high voltage being affected by said first selectable frequency, said second selectable frequency and the impedance of the gas discharge tube; and means for connecting said conversion means to the gas discharge tube.

2. The device according to claim 1 wherein said conversion means includes means for resonant conversion for producing said high voltage.

3. The device according to claim 1 further including sense means connected to said oscillator means and said conversion means for sensing an overvoltage condition on said conversion means and inhibiting said switching signals in response thereto.

4. An excitation device for gas discharge tubes, comprising:

supply means for connecting to an external power source and for supplying a DC voltage;

first timer means for adjustably producing a first frequency;

second timer means connected to said first timer means for adjustably producing a second frequency mixed with said first frequency; and means connected to said second timer means and to said supply means for converting said DC voltage into a selectable higher voltage in response to said second frequency.

5. The device according to claim 4 wherein said means for converting includes a power transformer driven by a resonant converter circuit.

6. The device according to claim 4 wherein said first adjustable frequency and said second adjustable frequency are ganged to change in parallel.

7. The device according to claim 4 further including adjusting means connected between said first timer means and said second timer means for varying the mixing of said second frequency by said first frequency.

8. An excitation device for gas discharge tubes having a fixed impedance, comprising:

first oscillator means for generating a first signal having a first selectable frequency;

second oscillator means for producing a second signal having a second selectable frequency;

combinations means for combining said first signal and said second signal and for producing a switching signal;

conversion means connected to said combination means operable in response to said switching signal for converting a lower DC voltage into a higher voltage;

said higher voltage having a selectable voltage being affected by said first selectable frequency of said first signal and the impedance of the gas discharge tube; and means for connecting said conversion means to the gas discharge tube.

9. The device according to claim 8 wherein said first selectable frequency is selected to be the same as said second selectable frequency.

* * * * *